United States Patent [19]

Hara

[11] Patent Number: 5,027,610

[45] Date of Patent: Jul. 2, 1991

[54] AUTOMATIC ICE MAKING MACHINE

[75] Inventor: Yasuo Hara, Toyoake, Japan

[73] Assignee: Hoshizaki Denki Kabushiki Kaisha, Aichi, Japan

[21] Appl. No.: 510,031

[22] Filed: Apr. 16, 1990

[51] Int. Cl.[5] ..... F25C 1/12

[52] U.S. Cl. ..... 62/135; 62/233

[58] Field of Search ..... 62/135, 138, 233

[56] References Cited

U.S. PATENT DOCUMENTS

| | | | |
|---|---|---|---|
| 3,277,661 | 10/1966 | Dwyer | 62/135 |
| 3,850,005 | 11/1974 | Sayles | 62/135 |
| 4,075,863 | 2/1978 | Wilson | 62/138 |
| 4,924,678 | 5/1990 | Ito | 62/138 |

*Primary Examiner*—William E. Tapolcai

*Attorney, Agent, or Firm*—Koda and Androlia

[57] ABSTRACT

Disclosed is an automatic ice making machine having an ice making section with an evaporator connected to a freezing system, a water feed system, an ice releasing unit, and a temperature detector which detects the temperature of the water to be frozen circulated through the water feed system; characterized in that said ice making machine further comprises a protection unit which stops the ice making operation after a predetermined time counted from the starting point of the ice releasing operation, if the temperature of the water to be frozen does not drop below a predetermined level. The automatic ice making machine may have a water level detector for detecting the level of water in a water tank instead of the temperature detector, and a protection unit which stops the ice making operation when the level of the water in the tank of the water feed system does not drop below the predetermined level within a predetermined time counted from the starting point of the ice making operation. These protection unit may have an alarm means which is actuated when the ice making operation is suspended or a means for releasing the protection manually.

5 Claims, 15 Drawing Sheets

(a)

(b)

(c)

TEMPERATURE OF FREEZING CHAMBER t
0°c
TIMER PRESET TIME
TIMER PRESET TIME
ICE MAKING
ICE MAKING
STOPPING
ICE RELEASING
CM
ON
OFF
FM
PM
T
AM
W.V.
H.V.
LS1
OPEN
CLOSED
LS2e-f
ON
OFF
LS2e-g
ON
OFF
LS3
ON
OFF
S1a-b
ON
OFF
S1a-c
ON
OFF

AUTOMATIC ICE MAKING MACHINE

BACKGROUND OF THE INVENTION

This invention relates to an automatic ice making machine, more particularly to an automatic ice making machine equipped with a protection unit which can effectively prevent compressor burning and waste of power during ice making operation.

Various types of automatic ice making machines for continually making various shapes of ice cakes including cube and plate in large quantities are utilized suitably depending on the applications. For example, popular ice making machines include:

(1) so-called closed cell system ice making machines having a multiplicity of freezing cells opening downward formed in a freezing chamber, in which the freezing cells can separably be closed with a water tray, and a water for freezing is injected into the freezing cells through the water tray to form ice cubes gradually therein;

(2) so-called open cell system ice making machines having a multiplicity of freezing cells opening downward, in which a water to be frozen is directly injected into the freezing cells in the absence of the water tray to form ice cubes in the freezing cells; and (3) flow-down system ice making machines having a tilted freezing plate, in which a water to be frozen is supplied to flow on the upper or lower surface of the freezing plate to form an ice plate on the corresponding surface.

These automatic ice making machines generally have an ice making mechanism in the upper part of the machine body and a freezing system for cooling said ice making mechanism at the lower part thereof, said freezing system comprising a compressor, a condenser, a capillary tube, an evaporator, etc.

The evaporator connected to this freezing system is disposed at the ice making section in the ice making mechanism to cool the ice making section; whereas a water to be frozen is circulably fed to the ice making section being cooled to form ice cakes, and upon detection of the growth of the ice cakes to a predetermined size by an ice formation detector which detects completion of ice formation, feeding of the water to be frozen is stopped. Subsequently, by the selective operation of a valve, a heated gaseous cooling medium from the compressor is adapted to be fed through a bypass tube to the evaporator to heat the ice making section and allow the ice cakes formed therein to drop by their own weight, whereby the ice cakes thus released are collected and accumulated in a stocker disposed below the ice making section. Incidentally, a fin and tube type condenser is generally used as the condenser of the freezing system which is forced to be cooled by a cooling fan.

As the protection unit for the freezing system which is actuated during the ice making operation, generally used are a motor protector attached to the compressor (overload protector), a pressure switch which detects the pressure of the cooling medium, etc. Also used are units in which the temperature of the cooling medium being condensed is detected by a temperature element such as thermostat and thermistor to actuate an alarm unit.

SUMMARY OF THE INVENTION

The conventional automatic ice making machines still involve problems of compressor or motor burning and waste of power and water to be frozen even when the protection units are actuated. To describe in detail:

(1) if the cooling fan motor for air freezing system condenser is rendered incapable of rotation (so-called fan locking) due to the damage of bearing etc., the condensing power of the condenser is greatly lowered, and the pressure of the cooling medium along the high pressure circuit, from the discharge side of the compressor to the charge side of the capillary tube, in the freezing system is elevated. On the other hand, the pressure of the cooling medium along the low pressure circuit from the discharge side of the capillary tube to the suction side of the compressor is also elevated. If the forced cooling of the compressor by the fan motor and also the cooling of the inside of the compressor by the gaseous cooling medium fail to be carried out properly in spite of the thus increased amount of circulating cooling medium, the compressor performs overload operation to require higher power to be overheated.

In such occasion, the motor protector, which protects the compressor from overload, is actuated to stop energization of the compressor. However, if the compressor is stopped, the pressure of the cooling medium within the freezing system circuit gradually drops and the temperature of the compressor itself is gradually lowered due to natural heat dissipation, so that the motor protector is automatically reset to resume eneregization of the compressor, and thus the overload operation. Then, the motor protector is actuated again to repeat the cycle of stopping and overload operation. Namely, under the above fan-locked condition, the compressor repeats the overload operation and stopping alternatively unless the user finds it and turns off the power switch. This causes not only waste of power but also deterioration of lubrication oil forming an oil film in the rotary section of the compressor. If the lubrication oil is thus deteriorated, smooth movement of the sliding section is inhibited to accelerate abrasion, causing burning or locking of the compressor itself or motor burning.

Thus, there is known an automatic ice making machine having a pressure switch disposed on the high pressure side of the freezing system for the purpose of preventing compressor burning to be caused by fan locking, which is adapted to be actuated in response to rise in the cooling medium pressure above the predetermined level to shut off the power supply to the compressor. However, since the pressure switch is designed to be actuated prior to the actuation of the motor protector (the degree of overload applied to the compressor is reduced compared with the case where no pressure switch is provided), and since the actuation pressure value of the pressure switch is set to a high level so that it may not be actuated under the normal condition, the compressor nevertheless performs overload operation under the fan-locked condition rather than under the normal operation.

Further, when the pressure switch is actuated when fan locking has occurred to stop the compressor, the cooling medium pressure is lowered due to natural heat dissipation, and when the temperature of the cooling medium is lowered to the minimum preset level, the internal contact of the pressure switch is closed to resume energization of the compressor and thus the overload operation. In other words, even with a pressure switch, the degree of the overload applied to the compressor is merely modified over the case mentioned above and the compressor still repeats the overload operation and stopping alternatively. Accordingly, this method still cannot substantially solve the problem.

On the other hand, there is known an automatic ice making machine provided with a pressure switch having locking function, in which once the pressure switch is actuated, the actuated posture of the switch is maintained to prevent repetition of the overload operation and stopping of the compressor, and resetting of the pressure switch is adapted to be performed manually. Such automatic ice making machine tends to be expensive disadvantageously, since the pressure switch used therein is expensive. Accordingly, generally employed is a method in which an off condensing temperature due to fan locking is detected by a temperature detector to actuate an alarm unit thereby so that the user may find occurrence of abnormality. In the absence of the operator, however, the repetition of the overload operation and stopping of the compressor cannot be prevented even if the motor protector and the pressure switch are actuated.

(2) The repetition of the overload operation and stopping of the compressor described above occurs not only in the case of fan locking but also when heat dissipation in the compressor is hindered because of the oil, dust, debris, etc. deposited on the heat exchange section to form a layer or because of choking with paper scraps in an air cooling system condenser; whereas in a water cooling system condenser, it occurs with the drop in the water feed pressure or with water suspension.

(3) In the case of three-phase condenser, if an open phase should have occurred for some reasons to perform open-phase operation, the internal motor is overheated to actuate the motor protector, and thus the on/off operation is repeated likewise to cause waste of power or burning of the compressor.

(4) When the compressor in the freezing system is out of order, the freezing system is rendered incapable of performing ice making operation, but the parts in the driving units such as the pump motor in the water feeding system, the fan motor for cooling the condenser, etc. continue to operate in vain to waste power and the water to be frozen.

The troubles in the automatic ice making machine include not only those in the compressor as described above but also in other sections, and different protection units must be provided to cope with other troubles respectively. The conventional automatic ice making machines having no such protection units suffer the following problems:

(5) When the solenoid valve performing opening/-closing of the bypass circuit in the freezing system for achieving release of ice cakes is rendered incapable of performing closing operation, the heated cooling medium directly flows into the evaporator, and thus the ice making section is rendered incapable of forming ice cakes. In such state, the other units including pump motor continue to operate in the absence of protection units therefor to cause waste of power and the water to be frozen.

(6) If leakage of the gaseous cooling medium occurs due to the deficient airtightness at the junction or other parts of the piping of the freezing system, the freezing power is lowered to render the machine incapable of performing the ice making operation. Accordingly, the compressor performs compression of the air flowing into the freezing system with no feeding of low temperature gaseous cooling medium thereto, so that the motor coil of the compressor is overheated to finally cause deterioration of the ice machine oil, abrasion in the sliding section, burning of the motor coil, etc. in a short while. Since no pressure rise occurs in this case, such accident cannot be prevented by the pressure switch disposed on the high pressure side of the compressor; and besides since the condensing temperature does not rise in the absence of the cooling medium, so that the alarm unit cannot be actuated, disadvantageously.

(7) If the water feed valve connected to the external water supply system connected to the internal water feed system is out of order to cause water leakage or rendered incapable of performing the closing operation, the feed of water from the external water supply system is continued to refrain cooling of the circulated water to be frozen, resulting in the failure of forming ice cakes. In this case also, the conventional ice making machine continues the ice making operation due to the absence of protection unit wasting power and water in vain.

(8) If icing occurs in the capillary tube due to the moist in the freezing system to block the tube, the machine is rendered incapable of performing ice making operation since no cooling medium is fed to the evaporator. In this case either, waste of power or water is caused due to the absence of such protection unit.

As described above, various troubles cause the waste of power and water to be frozen. However, if different protection units or detectors are disposed to cope with the various types of troubles respectively, the entire cost of the automatic ice making machine jumps up, disadvantageously.

BRIEF DESCRIPTION OF THE DRAWINGS

The attached drawings show preferred embodiments of the automatic ice making machine according to this invention, wherein:

FIG. 1 (*b*) shows schematically a constitution of the water tank according to a second embodiment of the automatic ice making machine of this invention;

FIG. 1 (*c*) shows schematically a constitution of the water tank according to a third embodiment of the automatic ice making machine of this invention;

PREFERRED EMBODIMENT OF THE INVENTION

This invention will be described below more specifically by way of preferred embodiments referring to the attached drawings.

Figure 1:
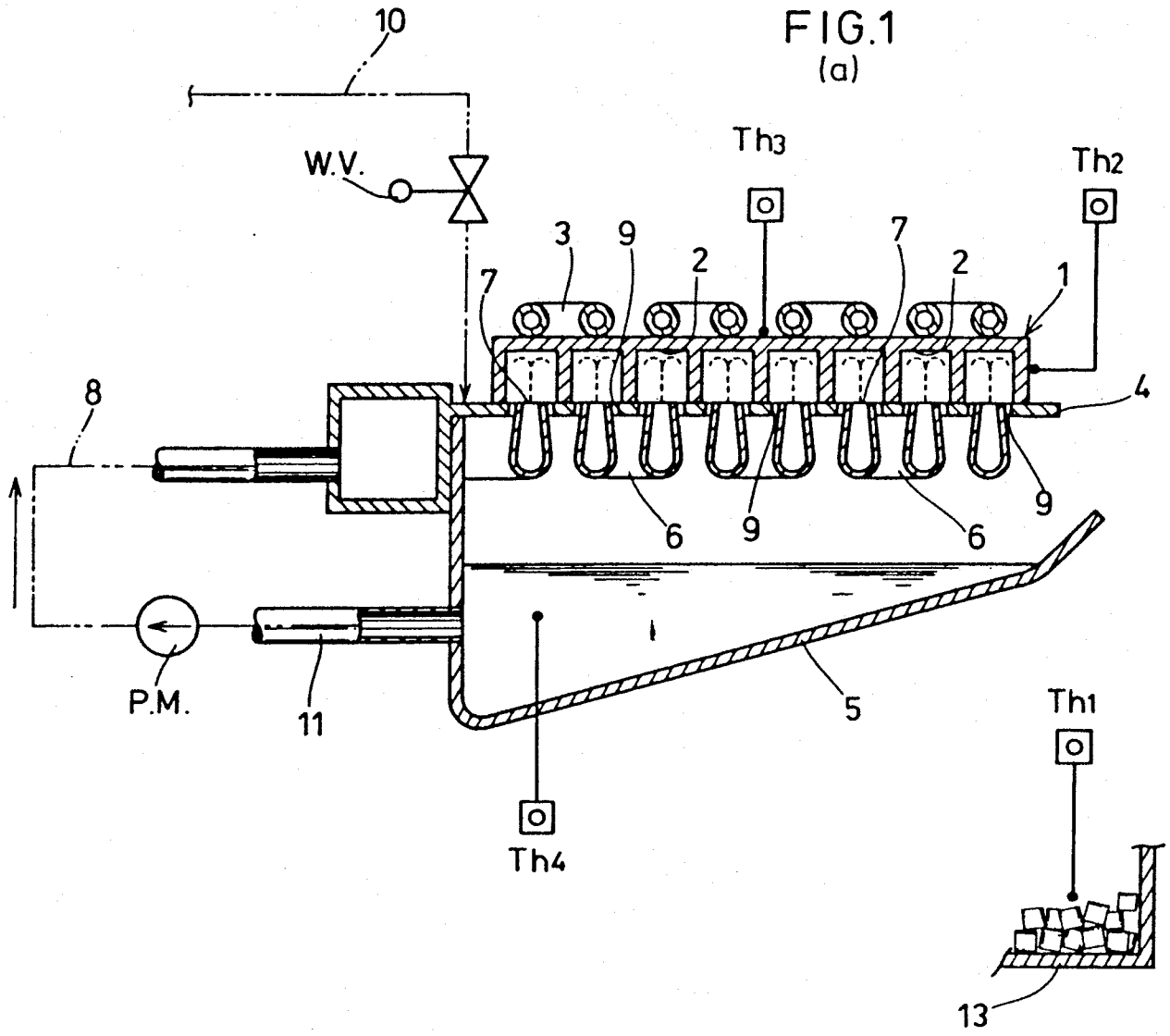
FIG. 1 (*a*) shows schematically a constitution of the ice making section and the water tank according to a first embodiment of the automatic ice making machine of this invention.
Figure 1:
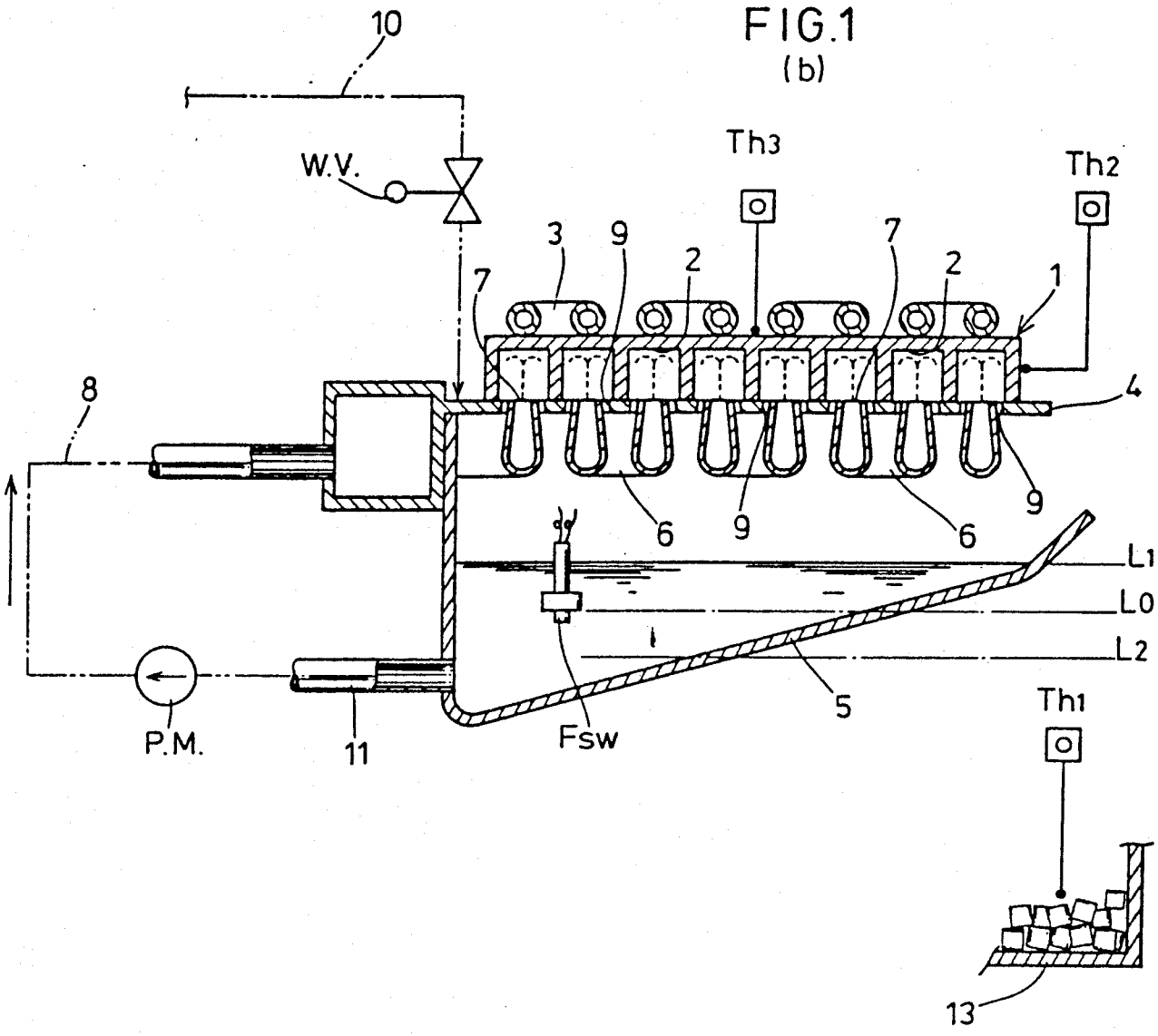
Figure 1:
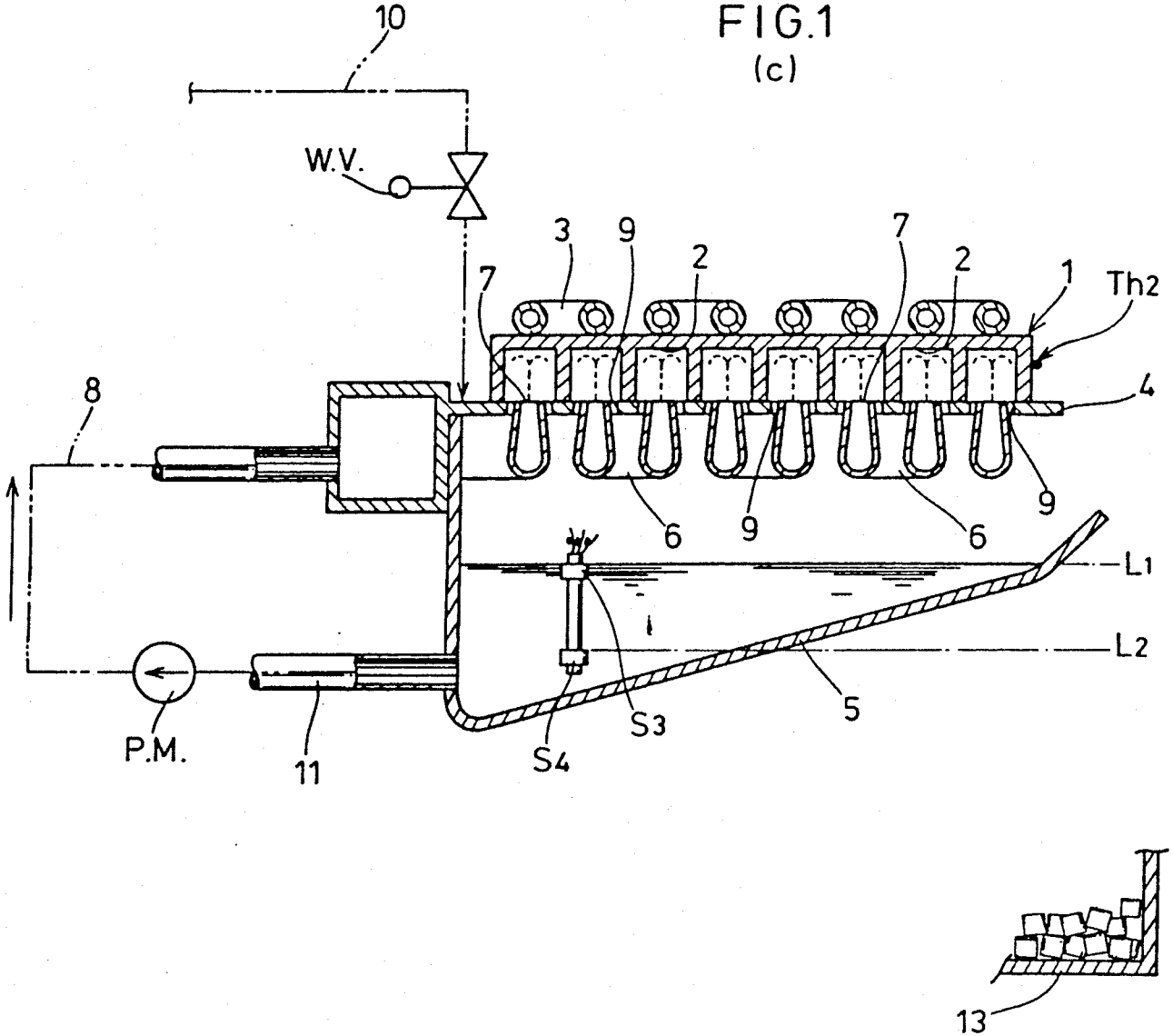

FIG. 1 (*a*) shows a first embodiment of the automatic ice making machine according to this invention. The automatic ice making machine has a freezing chamber 1 with a multiplicity of freezing cells 2 opening downward defined therein, and an evaporator 3 connected to the freezing system is disposed on the external upper wall surface of the freezing chamber 1. A water tray 4 is also disposed tiltably below the freezing chamber 1 to normally close the freezing cells 2 upwardly into a horizontal posture. The water tray 4 is supported pivotally at one end portion by means of a pivot not shown and forced to be tilted by an actuator during ice releasing operation to allow the freezing cells 2 to be open. On the lower surface of the water tray 4, a distribution pipe 6 is disposed for feeding the water to be frozen into each freezing cell 2, and further a water tank 5 is disposed beneath the water tray 4. A predetermined amount of water to be frozen necessary for one cycle of ice making operation is fed into the tank 5 through a water feed valve WV from the external water supply system 10.

The water within the water tank 5 is fed out from a lower position thereof through a water feed pipe 11 and a pump PM to the distribution pipe 6 and injected into each of the freezing cells 2 through multiplicity of water injection holes 7 formed in the water tray 4 correspondingly with the freezing cells 2. The water to be frozen is partly frozen onto the internal wall surface of each freezing cell 2, and the unfrozen water is fed back to the water tank 5 through water discharge holes 9 defined, on the water tray 4, adjacent to the respective water injection holes 7. The water to be frozen is circulated through the water feed system 8 having such constitution to allow ice layers to grow gradually in the freezing chamber 1.

In the third embodiment shown in FIG. 1(*c*), water level detector switches $S_3$ and $S_4$ are disposed in the water tank 5 at the predetermined water levels $L_1$ and $L_2$ ($L_1 > L_2$) respectively. One water level detector switch $S_3$ gives an ON-signal to the ice making control unit when the water level in the water tank 5 is above $L_1$ to notify that a sufficient amount of water to be frozen has been supplied into the tank 5 from the external water supply system 10 for starting ice making operation. On the other hand, the other water level detector switch $S_4$ gives an OFF-signal to the ice making control unit when the water level in the water tank 5 is below $L_2$ to notify completion of the ice making operation. The ice formation completion signal is also generated by a timer T to be described later after a predetermined time has passed counted from the starting point of the ice making operation. The ice making control unit is designed to start ice releasing operation upon receipt of the ice formation completion signal from the switch $S_4$ or the timer T.

On the external side wall surface of the freezing chamber 1, a temperature detector $Th_2$ comprising a temperature element such as thermostat and thermistor is closely disposed. The temperature detector $Th_2$ is designed to detect the temperature of the freezing chamber 1 and to be actuated to complete the ice making operation when the ice cakes in the freezing cells 2 grow fully to lower the temperature of the freezing chamber 1, and then it causes to start ice releasing operation.

In the automatic ice making machine shown in FIG. 1 (*a*) or (*b*), the pump PM is stopped when ice releasing operation is started to stop feeding of the water to be frozen, and the water tray 4 and the water tank 5 are tilted to a predetermined angle under the operation of the actuator not shown to discharge the unfrozen water remaining in the water feed system 8 completely. By the selective operation of the valve, a hot gas is fed into the evaporator 3 connected to the freezing system to warm the freezing chamber 1, so that the ice cakes formed in the freezing cells 2 may drop by their own weight to be guided into the ice reservoir 13.

The completion of dropping of the ice cakes into the ice reservoir 13 is detected by a temperature detector $Th_3$ comprising such as thermostat and thermistor closely disposed on the external upper wall surface of the freezing chamber 1 upon detection of the temperature rise in the freezing chamber 1. After detection of the completion of dropping of the ice cakes, the actuator is driven reversely to return the water tray 4 and the water tank 5 to the original horizontal position and close the freezing cells 2 upwardly, whereupon another portion of fresh water to be frozen is supplied into the water tank 5 through the water feed valve WV from the external water supply system 10. The pump PM then starts feeding of the water to be frozen into the freezing chamber 1, and the ice making is resumed. Incidentally, in the embodiment shown in FIG. 1(*c*), the water to be frozen is designed to be fed into the freezing chamber 1 through the pump PM after the water level in the tank 5 has reached above $L_1$.

In the first embodiment shown in FIG. 1(*a*), a temperature detector $Th_4$ comprising a temperature element such as thermostat or thermistor is disposed in the water tank 5 and adapted to detect the temperature of the water to be frozen in the water tank 5. In the second embodiment shown in FIG. 1(*b*), a water level detector $F_{sw}$ is disposed in the water tank 5 and adapted to detect the level of the water to be frozen in said tank 5. This water level detector $F_{sw}$ is set at an arbitrary level between the water level $L_1$ (when the ice making operation is started) and the water level $L_2$ (when the ice making operation is completed), substantially at an intermediate position $L_0$ between $L_1$ and $L_2$ in this embodiment for detecting abnormal water level; the water level detector $F_{sw}$ is designed to open its switch when the water level within the tank 5 is below $L_0$ and to close when it is above $L_0$.

The mark $Th_1$ in FIG. 1(*a*) or (*b*) shows an ice fullness detector switch disposed in the ice reservoir 13, which assumes a closed posture when the ice reservoir 13 is empty to start the ice making operation, while it assumes an open posture when a predetermined amount of ice cakes are stored in the ice reservoir 13 to stop the ice making machine.

Figure 2:
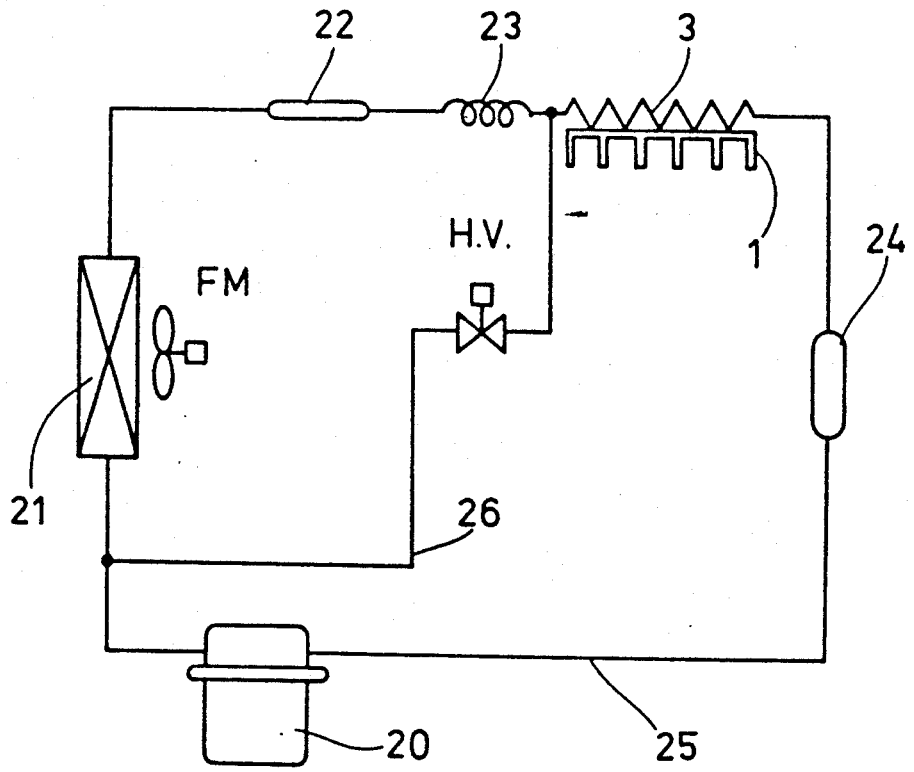
FIG. 2 shows a schematic diagram of the freezing system of the automatic ice making machine.

FIG. 2 shows schematically a constitution of the freezing system. The gaseous cooling medium compressed in a compressor 20 is condensed in a condenser 21 and liquefied. After designation in a dryer 22, the liquefied cooling medium is subjected to pressure reduction through a capillary tube 23 and then to evaporation in the evaporator 3 disposed on the external upper wall surface of the freezing chamber 1. Upon heat exchange of the cooling medium with the water to be frozen injected into the respective freezing cells 2, the water is allowed to be frozen within the respective freezing cells 2. The gasified cooling medium in the evaporator 3 and the liquid cooling medium remained ungasified flow into an accumulator 24 as a gas-liquid mixture, where they are separated into the respective phases; the gaseous phase cooling medium is fed back to the compressor 20 through a suction pipe 25, whereas the liquid phase cooling medium stays in the accumulator 24. Incidentally, the mark FM in FIG. 2 shows a fan motor for the condenser 21.

A hot gas pipe 26 branched from the discharge side of the compressor 20 communicates to the charge side of the evaporator 3 through a hot gas valve HV. The heated cooling medium discharged from the compressor 20 during the ice releasing operation flows into the evaporator 3 through the hot gas pipe 26 and the hot gas valve HV to warm the freezing chamber 1 and in turn the spherical surfaces of the ice cakes formed in the respective freezing cells 2 so that they may drop by their own weight. The heated cooling medium flowed out of the evaporator 3 then flows into the accumulator 24 to heat and evaporate the liquid phase cooling medium staying therein to feed it back as the gas phase through the suction pipe 25 to the compressor 20.

Figure 3:
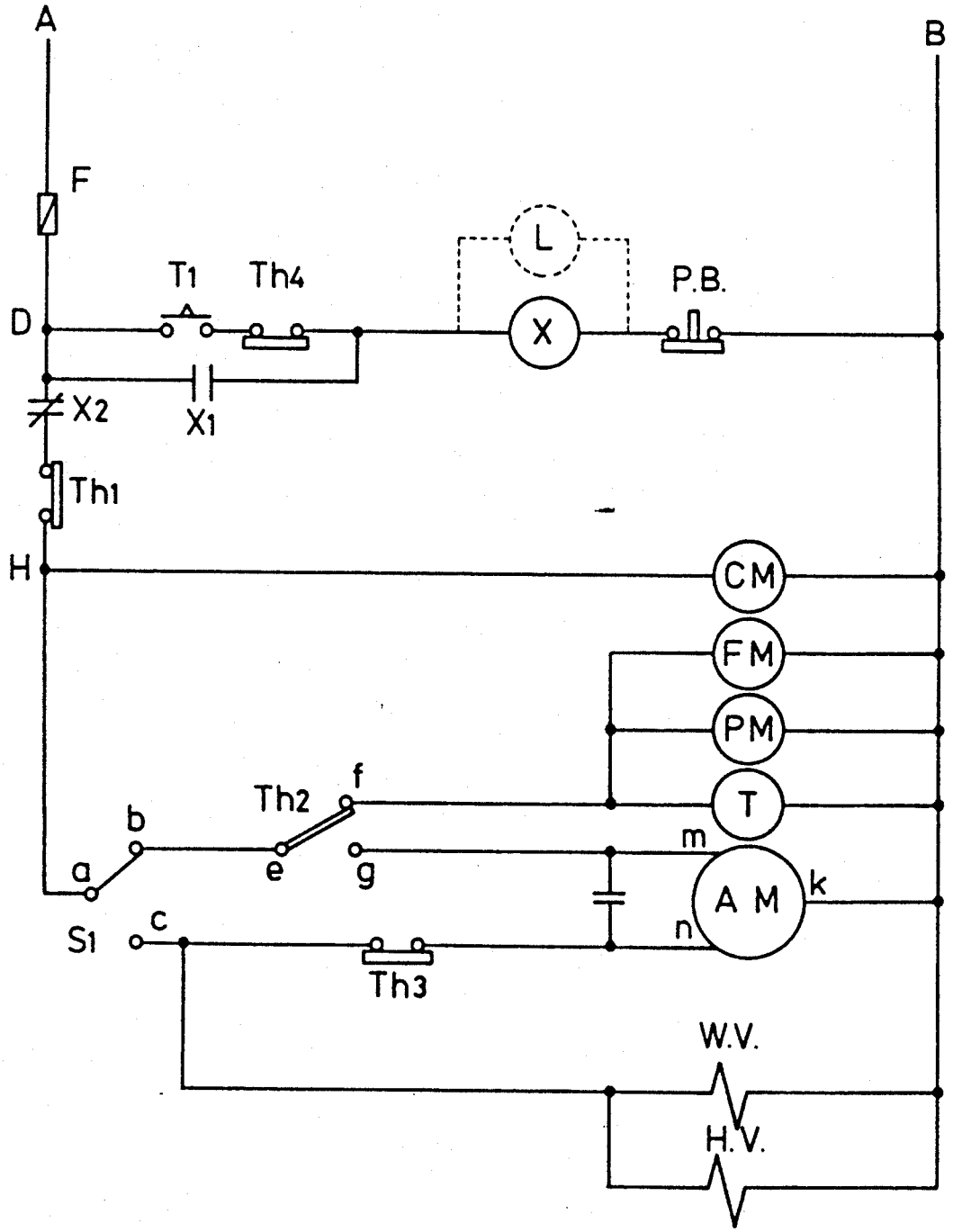
FIG. 3 shows an electric control circuit diagram of the automatic ice making machine according to the first embodiment.

FIG. 3 shows an example of electric control circuit of the first embodiment of the automatic ice making machine according to this invention, wherein a fuse F is disposed between a power supply line A and a connecting point D; and between the connecting point D and another power supply line B serially disposed are a make and break contact $T_1$ for the timer T to be described later, a temperature detector $Th_4$, a relay X and a reset push button PB. The connecting point connecting the make and break contact $T_4$ with the relay X is connected to the connecting point D through a normally open contact $X_1$ of the relay X. The temperature detector $Th_4$ operates to open its contact when the temperature of the water to be frozen is below the predetermined level t and to close it when it is above the predetermined level t. In this embodiment the timer T, the temperature detector $Th_4$ and the relay X constitute a protection unit.

Between the connecting point D and the connecting point H, a normally closed contact $X_2$ for the relay X and an ice fullness detector $Th_1$ are serially connected; whereas a compressor CM is disposed between the connecting point H and the power supply line B. The traveling contact a of the change-over switch $S_1$ to cause tilting of the water tray 4 when the ice cakes are to be released from the freezing chamber 1 is connected to the connecting point H, and the fixed contact b of the change-over switch $S_1$ is connected to the traveling contact f of the temperature detector $Th_2$ Between the fixed contact f of this temperature detector $Th_2$ and the power supply line B, disposed in parallel are a fan motor FM for cooling the condenser 21, a pump motor PM for circulating the water to be frozen and the timer T. The timer T closes the contact $T_1$ for a predetermined period of time $T_0$ after a predetermined preset time counted from the starting point of the operation of the fan motor FM and the pump motor (i.e. ice making operation).

Figure 4:
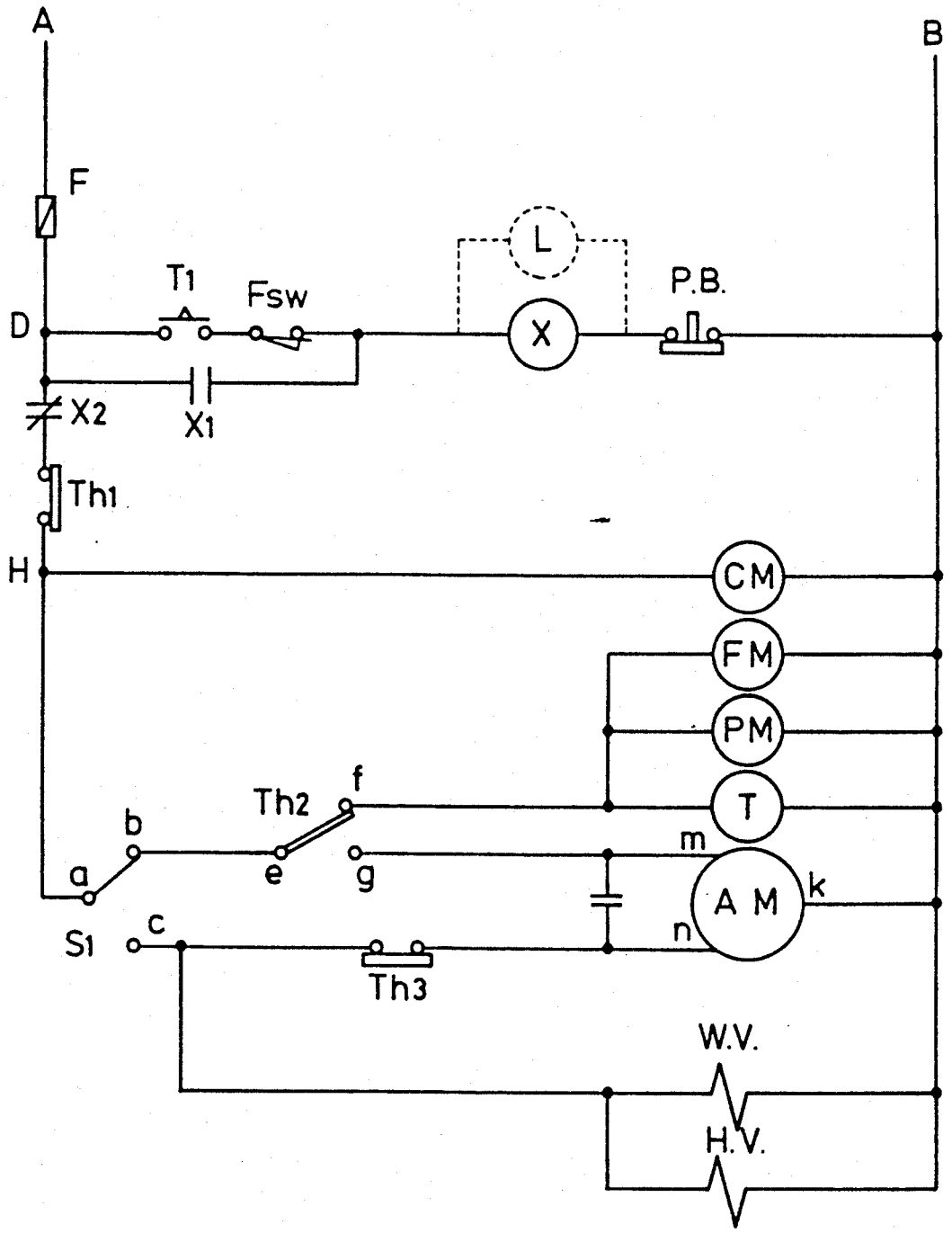
FIG. 4 shows an electric control circuit diagram of the automatic ice making machine according to the second embodiment.

The fixed contact g of the temperature detector $Th_2$ is connected to the power source terminal m for driving the actuator motor AM, which performs the tilting and resetting of the water tray 4, in the direction to cause the tilting motion; and the other power source terminal k of the actuator motor AM is connected to the power source line B. The fixed contact c of the change-over switch $S_1$ and the power source terminal n for causing the actuator motor AM to be driven in the resetting direction are connected to each other through a temperature detector $Th_3$; and a hot gas valve HV and a water feed valve WV are disposed parallel between the fixed contact c and the power supply line B. FIG. 4 shows an electric control circuit diagram of the embodiment shown in FIG. 1(*b*), and the difference between the electric control circuit diagram shown in FIG. 4 and the one shown in FIG. 3 is only that a water level detector $F_{sw}$ is disposed, instead of the temperature detector $Th_4$, in the former.

Figure 5:
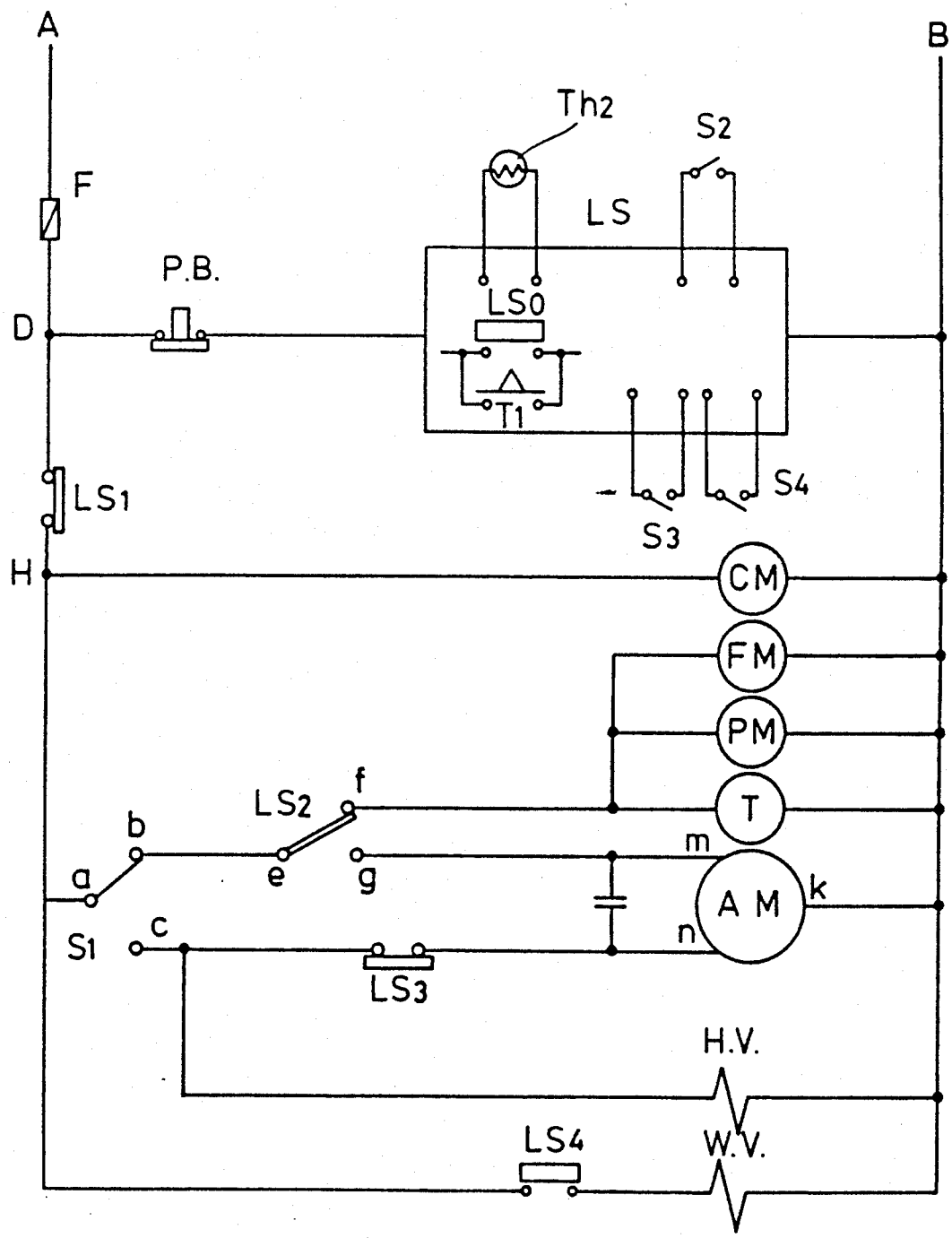
FIG. 5 shows an electric control circuit diagram of the automatic ice making machine according to the third embodiment.

FIG. 5 shows an electric control circuit diagram of the embodiment shown in FIG. 1(*c*), where a reset push button PB and an ice making control unit LS are serially connected. A make and break contact $LS_1$ of this ice making control unit LS is interposed between the connecting point D and the connecting point H, and the traveling contact e of the change-over contact $LS_2$ is connected to the fixed contact b of the change-over switch $S_1$. Between the traveling contact a (connecting point H) and the power supply line B interposed are a make and break contact $LS_4$ of the ice making control unit LS and a water feed valve WV.

The ice making control unit LS comprises a temperature element $Th_2$ disposed on the side wall of the freezing chamber 1 for detecting the temperature thereof, an ice fullness detector switch $S_2$ which is actuated when a predetermined amount of ice cakes are accumulated in the ice reservoir 13 and water level detector switches $S_3$ and $S_4$, and also has contacts $LS_1$, $LS_2$, $LS_3$ and $LS_4$ in addition to a make and break contact $LS_0$ disposed parallel to the contact $T_1$ of the timer T.

Make/break operation and change-over operation of these contacts $LS_0$, $LS_1$, $LS_2$, $LS_3$ and $LS_4$ are controlled by the signals from the temperature element $Th_2$, the ice fullness detector switch $S_2$ and the water level detector switches $S_3$ and $S_4$ as follows. To describe in detail, the make and break contact $LS_0$ is basically actuated in response to the water level detector switch $S_4$ to assume a closed posture when the water detector switch $S_4$ is made open upon dropping of the water level in the water tank 5 below $L_2$.

The make and break contact $LS_1$ is basically made open when the ice fullness detector switch $S_2$ is closed as soon as a predetermined amount of ice cakes are accumulated in the ice reservoir 13, and it is closed when the ice fullness detector switch $S_2$ is made open as soon as the amount of the ice cakes in the ice reservoir 13 has dropped below a predetermined level. The make and break contact LS also assumes an open posture when the water level detector switch $S_3$ is closed since the water level in the tank 5 is at $L_1$ at the point that the make and break contact $T_1$ is closed after the timer T has counted up the predetermined preset time, as it detects the above state as an occurrence of some abnormality such as fan locking. The open posture of the contact $LS_1$ in the case of such abnormality is designed to be retained by the ice making control unit on its own, and the self-retention cannot be cleared unless the push button PB is depressed or the power switch is turned off.

The traveling contact e of the change-over contact $LS_2$ is changed over to the fixed contact g when the contact $LS_0$ is closed (water level $<L_2$) or when the make and break contact $T_1$ disposed parallel to the contact $LS_0$ is closed after the timer has counted up the predetermined preset time and also the water level detector switch $S_3$ is made open since the water level within the tank 5 is below $L_1$ The change-over switch $LS_2$ is reset (the traveling contact e is connected to the fixed contact f), when the traveling contact a of the switch $S_1$ to be changed over by the tilting motion of the water tray 4 is changed over to the fixed contact c.

The make and break contact $LS_3$ is closed upon detection of a temperature rise in the freezing chamber 1 from 0° C. to a predetermined level by the temperature element $Th_2$, whereas it is made open when the traveling contact a of the switch $S_1$ is changed over from the fixed contact c to the fixed contact b.

The make and break contact $LS_4$ is closed when the traveling contact a of the switch $S_1$ is changed over from the fixed contact c to the fixed contact b and made open when the water level detector switch $S_3$ is closed after the water level within the water tank 5 has reached above $L_1$.

Operation of the first and second embodiments

Figure 6:
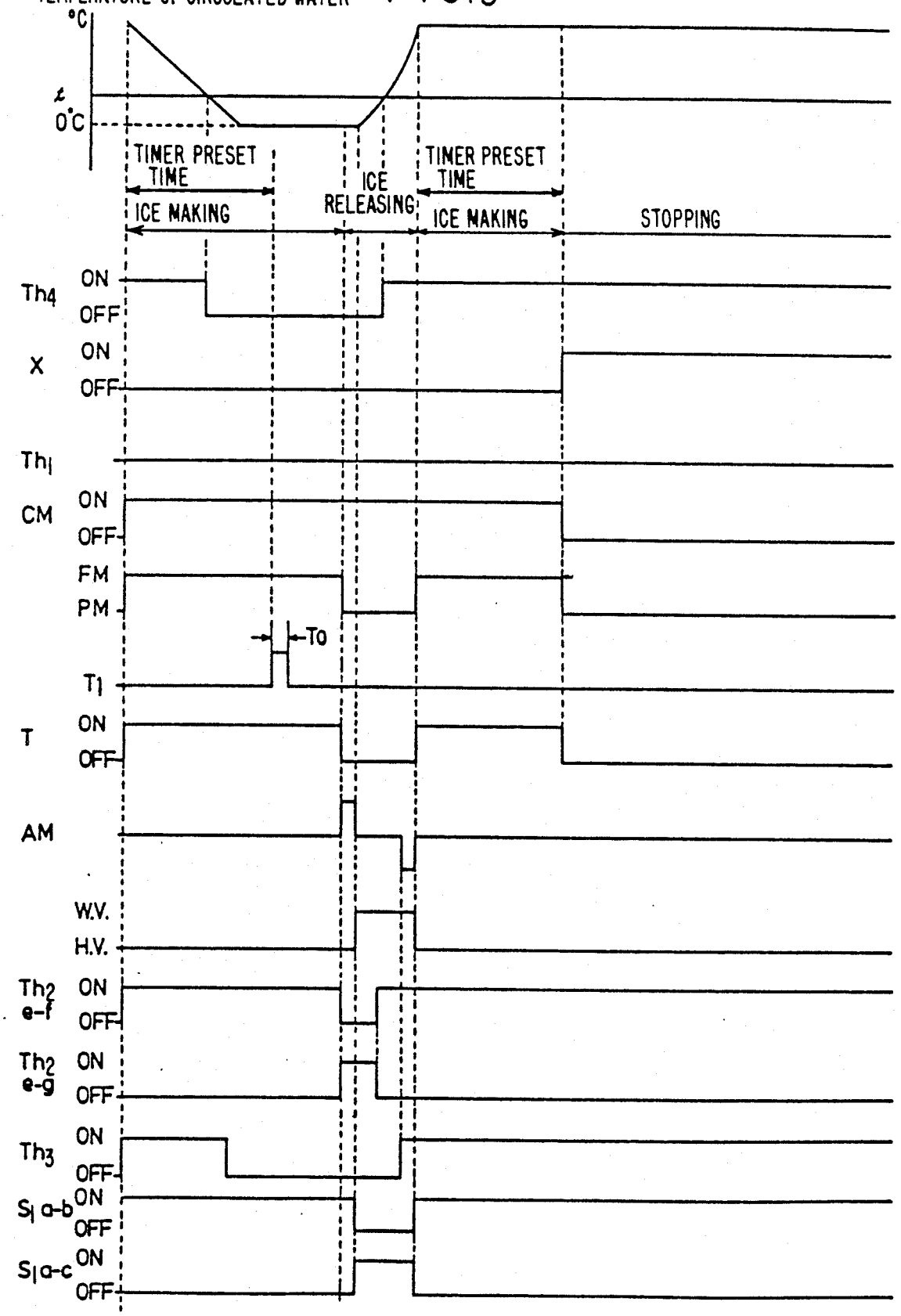
FIG. 6 shows a timing chart explaining the operation of the first embodiment.
Figure 7:
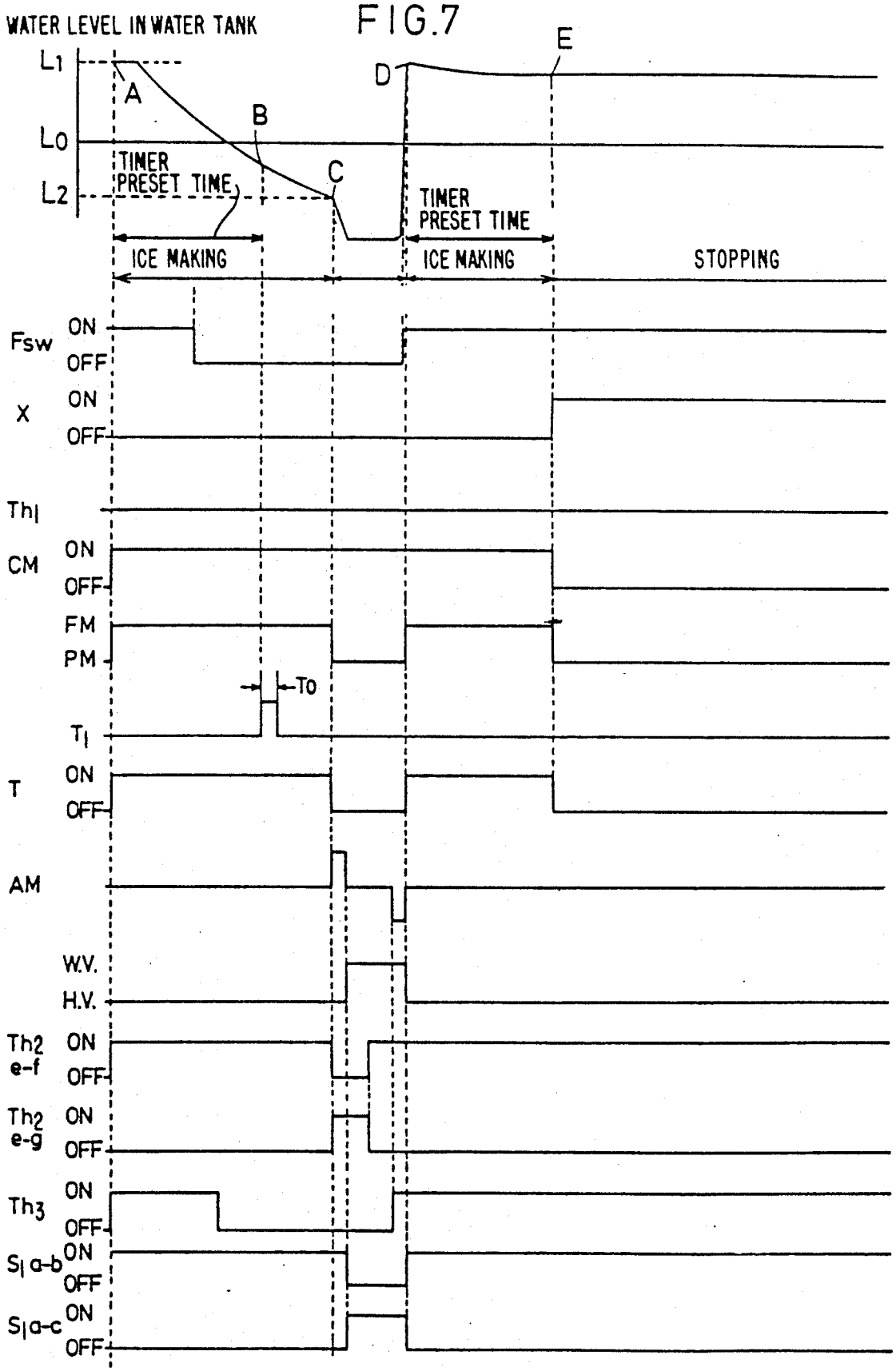
FIG. 7 shows a timing chart explaining the operation of the second embodiment.

Next, the operation of the first embodiment shown in FIG. 1(*a*) and that of the second embodiment shown in FIG. 1(*b*) will be explained referring to the timing charts shown in FIGS. 6 and 7, respectively. A power switch (not shown) of the automatic ice making machine is first turned on. Since no ice cake is stored in the ice reservoir 13 at this stage, the ice fullness detector $Th_1$ is closed. Since the traveling contact a of the change over switch $S_1$ is connected to the fixed contact b, and the temperature of the freezing chamber 1 is substantially at room temperature, the traveling contact e of the temperature detector $Th_2$ is connected to the fixed contact f. Accordingly, as soon as the power switch is turned on, the compressor (CM) 20, fan motor FM, pump motor PM and timer T are energized to start ice making operation. Then, the cooling medium and the water to be frozen are circulated, and thus the temperature of the circulated water and that of the freezing chamber 1 are gradually lowered. When the machine is performing normal ice making operation, the temperature of the water circulated becomes 0° C. after a predetermined time counted from the starting point of the ice making operation. Incidentally, the abnormality preset temperature t of the temperature detector $Th_4$ is set to a level higher than 0° C., and the preset time of the timer T is longer than the time actually required for lowering the temperature of the water to be frozen to 0° C. counted from the starting point of the ice making operation. Upon dropping of the temperature of the water to be frozen (temperature of the freezing chamber 1) below t, the temperature detector $Th_4$ is made open, and upon dropping further to 0° C., ice starts to grow.

In the second embodiment shown in FIG. 1(*b*) the water level within the tank 5 drops from $L_1$ through $L_0$ to $L_2$ gradually as ice cakes grow in the freezing cells 2.

As soon as the timer T, counting time from the starting point of the ice making operation, has counted up the preset time, the timer T closes its contact $T_1$ for a predetermined time $T_0$ and then makes it open again. However, since the temperature detector $Th_4$ is made open at that time (the water level detector $F_{sw}$ is made open in the embodiment shown in FIG. 1(*b*) because the water level in the tank 5 is below $L_0$), the relay X is not energized even if the contact $T_1$ is closed, and the normally closed contact $X_2$ of the relay X remains as closed.

When formation of ice cakes were completed, the temperature detector $Th_2$ detects it and connects the travelling contact e thereof to the fixed contact g; whereupon the fan motor FM, pump motor PM and timer T are deenergized and the actuator motor AM is energized to start ice releasing operation. Upon rotation of the actuator motor AM, the water tray 4 and the water tank 5 start to tilt, and at the end of the tilting motion, the traveling contact a of the change-over switch $S_1$ is changed over to the fixed contact c, wherein the temperature detector $Th_3$ is assuming an open posture. The changing over of the change-over switch $S_1$ urges the water feed valve WV to open, whereby another portion of fresh water of higher temperature is supplied to the tank 5 from the external water supply system. With the opening of the hot gas valve HV, the evaporator 3 is warmed to accelerate release of the ice cakes. As described above, when the temperature of the freezing chamber 1 has risen after the ice cakes formed in the freezing cells 2 dropped by their own weight, the temperature detector $Th_3$ detects completion of ice releasing operation and assumes a closed posture.

In the first embodiment shown in FIG. 1(*a*), the temperature detector $Th_4$ is assuming a closed posture since the temperature of the water to be frozen is above t; whereas in the second embodiment shown in FIG. 1(*b*), the water level detector $F_{sw}$ is assuming an open posture since the water level is below $L_0$. The traveling contact e of the temperature detector $Th_2$ is connected to the fixed contact f. The actuator motor AM is energized when the temperature detector $Th_3$ is closed to start reverse rotation and allow the water tray 4 to return to the original horizontal posture. After completion of the resetting motion, the traveling contact a of the change-over switch $S_1$ is changed over to the fixed contact b to resume the ice making operation and repeat the above procedures.

If any trouble should have occurred such as the reduction in the condensing power due to the fan locking, condenser clogging, etc., reduction in the water feed pressure or water suspension in a water cooling system condenser, open-phase operation in three-phase compressor, leakage of gaseous cooling medium, compressor trouble, deficient closing operation of the hot gas valve HV, and icing in the freezing system to cause chalking, the freezing power of the machine is extremely lowered to be incapable of lowering the temperature of the freezing chamber 1 during the ice making operation. Accordingly, the temperature of the water to be frozen cannot be lowered and never drops below the abnormality preset temperature t even after the ice making operation started, and the temperature detector $Th_4$ retains its closed posture. As soon as the timer T has counted up the predetermined preset time to close its contact $T_1$, a circuit: power supply line A →fuse F→connecting point D →contact $T_1$→temperature detector $Th_4$ (or water level detector $F_{sw}$ in the embodiment of FIG. 1(*b*)) →relay X →reset push button PB →power supply line B s formed to energize the relay X, whereby the normally open contact $X_1$ of the relay X is closed and the normally closed contact $X_2$ is made open. By the closing of the normally open contact $X_1$ the continuity of the relay X is retained on its own, and by the opening of the normally closed contact $X_2$ the compressor motor CM, fan motor FM and pump motor PM are deenergized.

Operation of the third embodiment

Next, the operation of the third embodiment of the automatic ice making machine will be described referring to the flow chart shown in FIG. 8 and the timing chart shown in FIG. 9. A power switch (not shown) of the automatic ice making machine is first turned on. Since no ice cake is stored in the ice reservoir 13 at this stage, the ice fullness detector switch $S_2$ is made open, so that the make and break contact $LS_1$ of the ice making control unit LS is closed. Since the traveling contact a of the change-over switch $S_1$ is connected to the fixed contact b, and the traveling contact e of the change-over contact $LS_2$ is connected to the fixed contact f. Accordingly, as soon as the power switch is turned on, the compressor (CM) 20, fan motor FM, pump motor PM and timer T are energized to start ice making operation. Then, the cooling medium and the water to be frozen are circulated as described referring to FIGS. 1(*a*), (*b*), (*c*) and 2, and thus the temperature of the circulated water and that of the freezing chamber 1 are gradually lowered. When the machine is performing normal ice making operation, the temperature of the water circulated becomes 0° C. after a predetermined time counted from the starting point of the ice making operation, and ice layers start to grow.

The water level in the tank 5 is gradually lowered with the growth of ice cakes, and when it is lowered below $L_2$, the switch $S_4$ gives an OFF-signal showing completion of ice making operation, whereby the make and break contact $LS_0$ of the ice making control unit LS is closed to change over the traveling contact e of the change-over contact $LS_2$ to the fixed contact g. Namely, the step 1 of the flow chart 8 proceeds to the step 2 to start ice releasing operation. When the ice releasing operation is started, the fan motor FM, pump motor PM and timer T are deenergized and the actuator motor AM is energized. By the rotation of the actuator motor AM, the water tray 4 and the water tank 5 are tilted to a predetermined angle to open the freezing cells 2. Upon completion of the tilting motion, the traveling contact a of the change-over switch $S_1$ is changed over to the fixed contact c, whereby the make and break contact $LS_4$ of the ice making control unit LS is closed.

At this stage, the make and break contact $LS_3$ of the ice making control unit is assuming an open posture. The changing over of the change-over switch $S_1$ urges the water feed valve WV to be open, whereby another portion of fresh water of normal temperature is supplied to the tank 5 from the external water supply system. With the opening of the hot gas valve HV, a hot gas is fed to the evaporator 3 to warm the evaporator 3 and melt the surfaces of the ice cakes frozen to the freezing cells 2 to accelerate releasing of the ice cakes. Namely, when the temperature of the freezing chamber 1 has risen after the ice cakes in the freezing cells 2 have dropped by their own weight as described above, the temperature detector $Th_2$ detects it and closes the make and break contact $LS_3$. Upon closure of the make and break contact $LS_3$, the actuator motor AM is rotated reversely to return the water tray 4 to the original horizontal posture, and after completion of the resetting motion the traveling contact a of the changeover switch $S_1$ is changed over to the fixed contact b to resume the ice making operation and repeat the above procedures.

Figure 8:
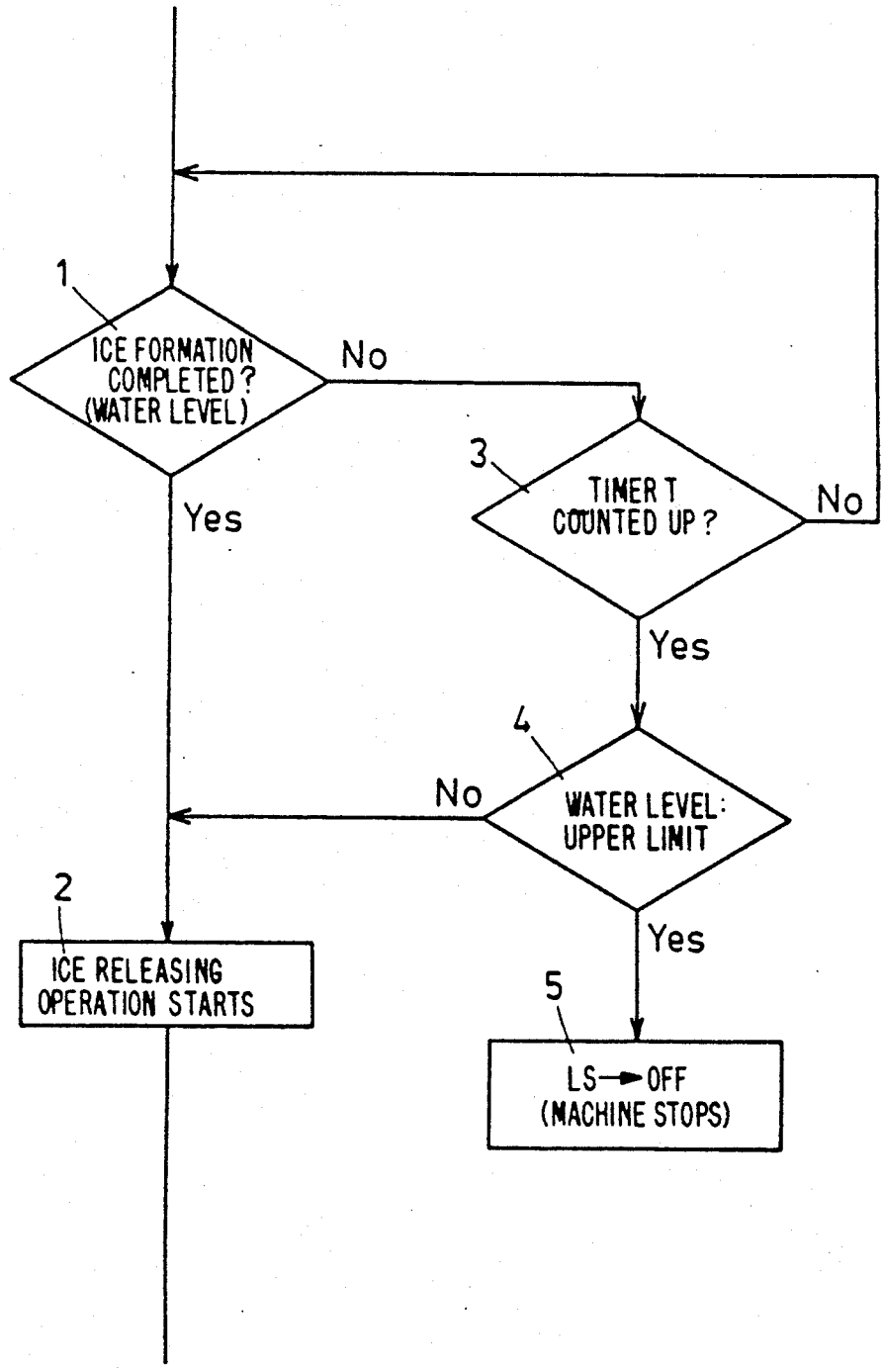
FIG. 8 shows a flow chart explaining the operation of the third embodiment.
Figure 9:
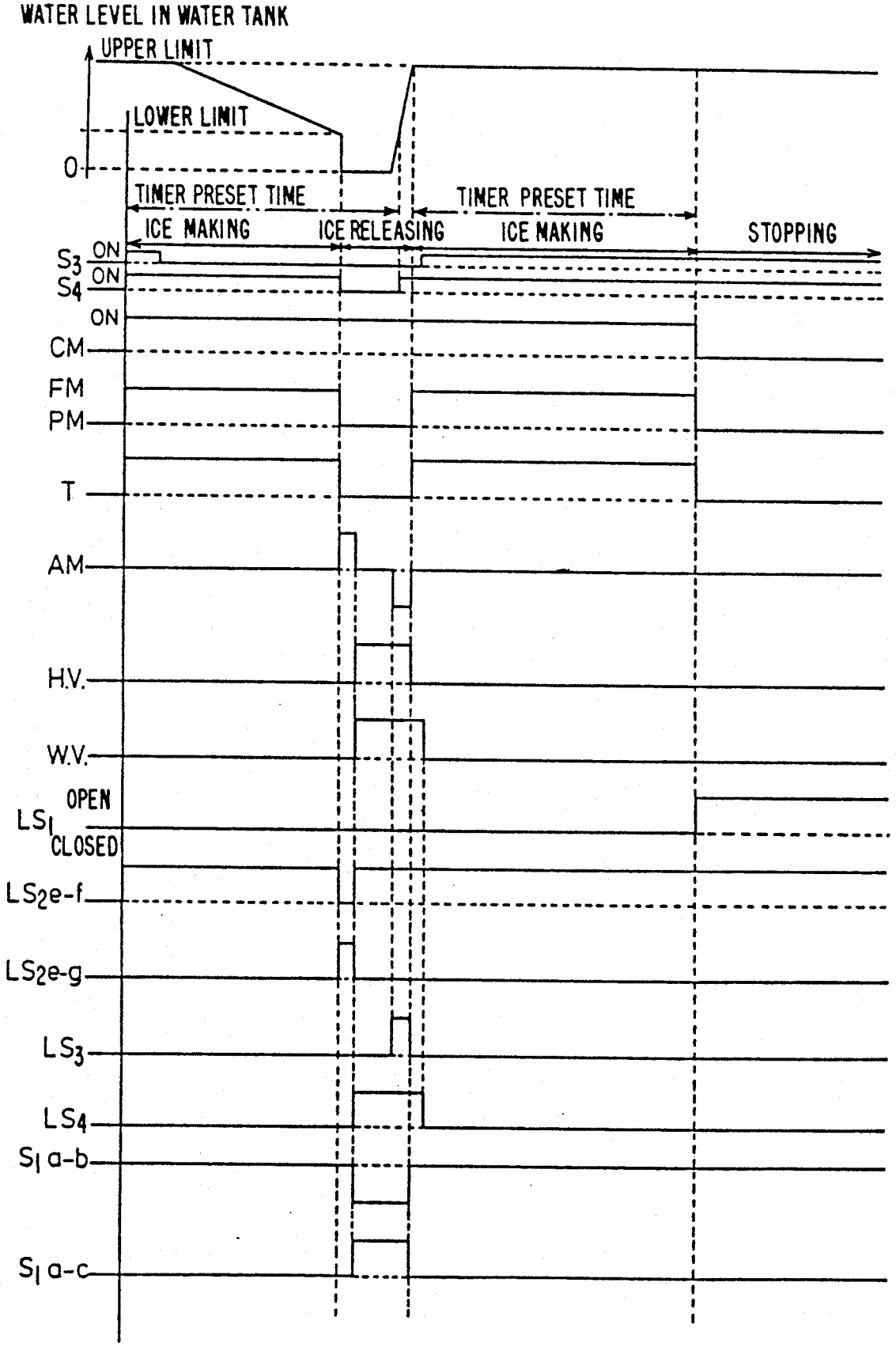
FIG. 9 shows a timing chart explaining the operation of the third embodiment.

If the environmental temperature of the automatic ice making machine has risen such as in summer to require longer time until completion of the ice making operation, the step 1 of the flow chart shown in FIG. 8 proceeds to the step 3, and the timer T counts up and closes its make and break contact $T_1$ before the water level detector switch $S_4$ gives an ice formation completion signal. When the time required for the formation of ice cakes is extended merely for some other reasons as described above even if the ice making machine is performing normal ice making operation, the ice cakes formed in the freezing chamber 1 have a substantially complete form, although not perfect. Accordingly, the water level in the tank 5 has surely dropped below the upper limit water level $L_1$, and the water level detector switch $S_3$ is assuming an open posture. Therefore, the step 3 of the flow chart of FIG. 8 proceeds to the step 4 and then to the step 2. In other words, the traveling contact e of the change-over contact $LS_2$ is changed over to the fixed contact g, whereby the ice releasing operation is started again. As described above, this embodiment provides an advantage that a predetermined amount of ice cakes can be obtained even when the environmental temperature is elevated such as in summer.

If any trouble should have occurred such as the reduction in the condensing power due to the fan locking, condenser clogging, etc., reduction in the water feed pressure or water suspension in a water cooling system condenser, open-phase operation in three-phase compressor, leakage of gaseous cooling medium, compressor trouble, deficient closing operation of the hot gas valve HV and icing in the freezing system to cause chalking, the freezing power of the machine is extremely lowered to be incapable of lowering the temperature of the freezing chamber even during the ice making operation. Accordingly, the temperature of the water to be frozen circulated being brought into contact with the freezing chamber 1 fails to drop, and also the water level in the water tank 5 never drops further from the upper limit water level $L_1$ so that the water level detector switch $S_3$ retains its closed posture. When the timer T has counted up the preset time to close the contact $T_1$, the step 3 of FIG. 8 proceeds on to the step 4 and then to the step 5, and thus the make and break contact $LS_1$ is made open, whereby the compressor CM, fan motor FM and pump motor PM are deenergized.

Figure 10:
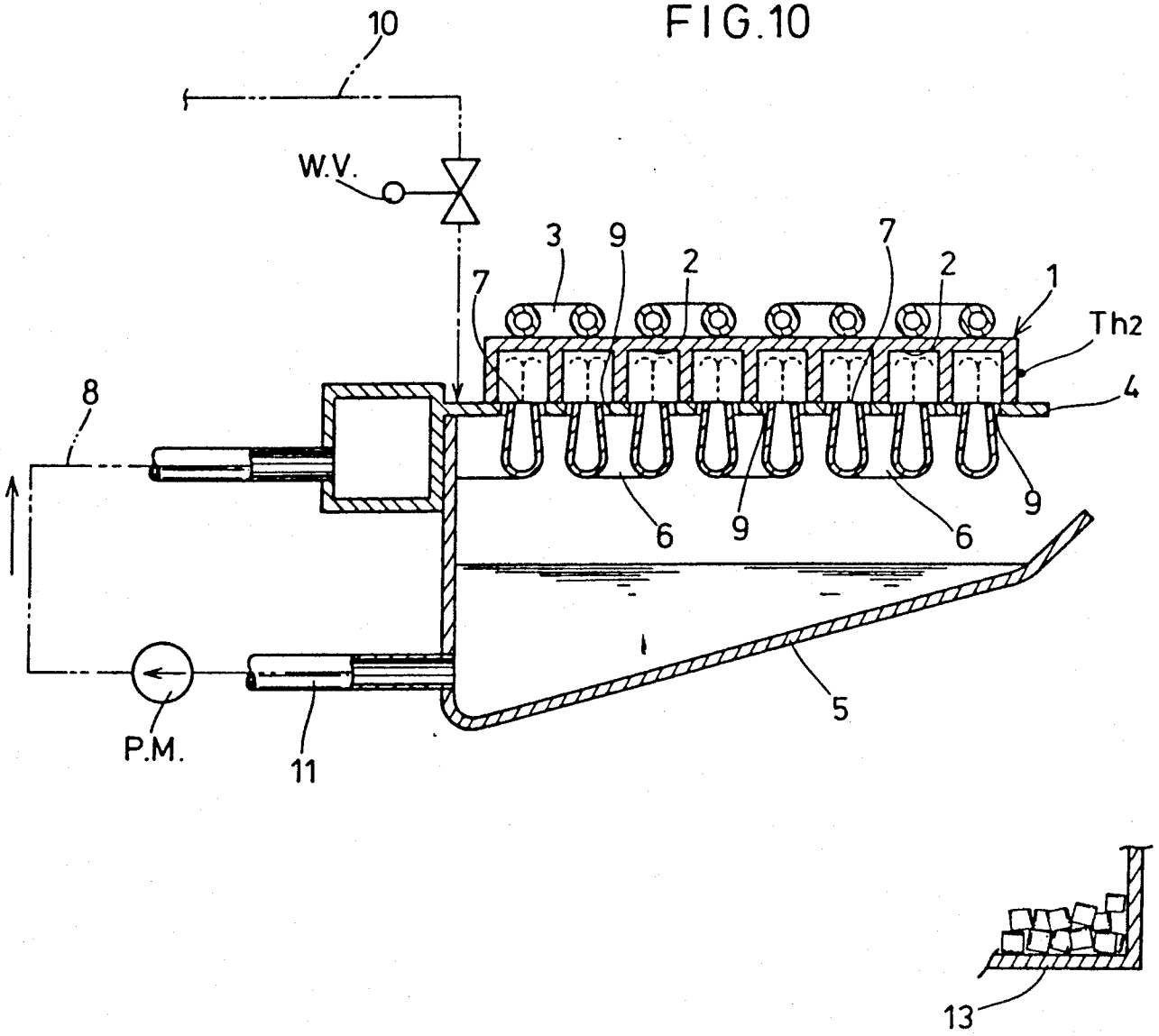
FIG. 10 shows schematically a constitution of the water tank according to a fourth embodiment of the automatic ice making machine of this invention.

FIG. 10 shows the major section of the fourth embodiment of the automatic ice making machine, wherein an ice making control unit Th to be descried later is designed to give an ice formation completion signal and other signals depending on the temperature detected by the temperature element $Th_2$ Accordingly, the automatic ice making machine of the fourth embodiment is different from that of the third embodiment in that the water level detector switches $S_3$ and $S_4$ are omitted in the former.

Figure 11:
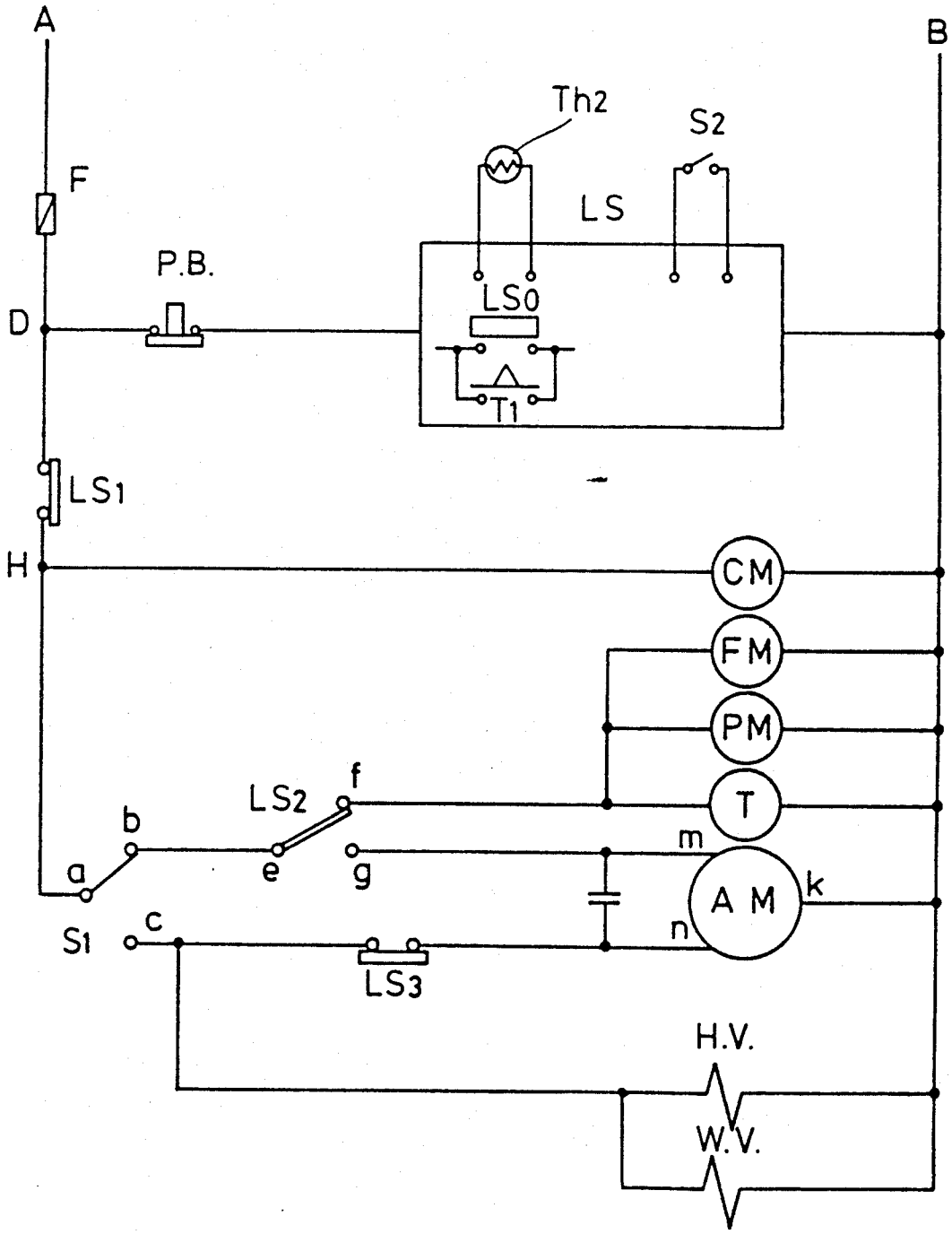
FIG. 11 shows an electric control circuit diagram of the automatic ice making machine according to the fourth embodiment.

FIG. 11 shows an example of electric control circuit of the fourth embodiment of the automatic ice making machine, wherein a fuse F is disposed between the power supply line A and the connecting point D; a reset push button PB and an ice making control unit $Ls_1$ are serially connected between the connecting point D and the power supply line B; and a make and break contact $Ls_1$ of the ice making control unit T is interposed between the connecting point D and the connecting point H. Further, a compressor CM (20) is disposed between the connecting point H and the power supply line B. When the ice cakes formed in the freezing chamber 1 are released, the traveling contact a of the change-over switch $S_1$ for causing the water tray 4 to be tilted is connected to the connecting point H, and the fixed contact b of this change-over switch $S_1$ is connected to the traveling contact f of the change-over contact $Ls_2$. Between the fixed contact f of the change-over contact $Ls_2$ and the power supply line B, a fan motor FM for cooling the condenser 21, a pump motor PM for circulating the water to be frozen and the timer T are connected parallel to each other. The timer T is designed to close a normally open contact $T_1$ to be described later disposed in the ice making control unit Ls for a predetermined time after a predetermined preset time counted from the starting point of the operation of the fan motor FM and the pump motor PM (i.e. the starting point of the ice making operation).

The fixed contact g of the change-over contact $Ls_2$ is connected to the power source terminal m for driving the actuator motor AM (which performs tilting and resetting of the water tray 4 etc.) in the tilting direction; whereas the other power source terminal k of the motor AM is connected to the power supply line B. The fixed contact c of the change-over switch $S_1$ and the power source terminal n of the actuator motor AM for driving it in the resetting direction are connected through the make and break contact $Ls_3$ of the ice making control unit Ls; and a hot gas valve HV and a water feed valve WV are connected parallel to each other between the fixed contact c and the power supply line B.

The ice making control unit Ls comprises a temperature element $Th_2$ for detecting the temperature in the freezing chamber 1 and an ice fullness detector switch $S_2$ which is actuated when the ice cakes accumulated in the ice reservoir 13 has reached the predetermined level and also has contacts $Ls_1$, $Ls_2$ and $Ls_3$ in addition to the make and break contact $Ls_0$ connected parallel to the contact $T_1$ of the timer. The make/break operation and the change-over operation of these contacts $Ls_0$, $Ls_1$, $Ls_2$ and $Ls_3$ are controlled based on the signals given from the temperature element $Th_2$ and the ice fullness detector switch $S_2$ in the following manner.

To describe in detail, the make and break contact $Ls_0$ is basically actuated in response to the temperature element $Th_2$ and closed upon detection of the temperature drop in the freezing chamber 1 fully to a preset temperature below 0° C. so that it can be judged that the formation of ice in the freezing chamber 1 has been completed.

The make and break contact $Ls_1$ is basically made open when the ice fullness detector switch $S_2$ is closed as soon as a predetermined amount of ice cakes are accumulated in the ice reservoir 13 and closed when the ice fullness detector switch $S_2$ is made open as soon as the amount of the ice cakes in the ice reservoir 13 has dropped below a predetermined level. The make and break contact $Ls_1$ also assumes an open posture when the timer T has counted upon the predetermined preset time to close it make and break contact $T_1$ and further the temperature element $Th_2$ has detected temperature rise above the predetermined abnormal preset temperature level (for example 0° C.) as it judges that some abnormality has occurred such as fan locking. The open posture of the contact $Ls_1$ in the case of such abnormality is designed to be retained by the ice making control unit on its own, and the self-retention cannot be cleared unless the push button PB is depressed or the power switch is turned off.

The traveling contact e of the change-over switch $Ls_2$ is changed over to the fixed contact g, when the temperature of the freezing chamber 1 has dropped to a level flow enough to show completion of ice formation, or when the timer T has counted up the predetermined preset time to allow the make and bleak contact $T_1$ disposed parallel to the contact $Ls_0$ to close and also the temperature element $Th_2$ has detected that the temperature of the freezing chamber 1 is under the abnormality preset temperature. The change-over contact $Ls_2$ is reset (the traveling contact e is connected to the fixed contact f), when the traveling contact a of the switch $S_1$, to be changed over by the tilting motion of the water tray 4, is changed over from the fixed contact b to the fixed contact c.

The make and break contact $Ls_3$ is closed upon detection of temperature rise in the freezing chamber from 0° C. to a predetermined level by the temperature element $Th_2$, whereas it is made open when the traveling contact a of the switch $S_1$ is changed over from the fixed contact c to the fixed contact b.

The setting time in the timer T is designed to be longer than the time actually required for the completion of normal ice making operation, and to give an ice formation completion signal upon detection of completion of ice formation by the temperature element $Th_2$.

Operation of the fourth embodiment

Next, the operation of the fourth embodiment of the automatic ice making machine will be described referring to the flow chart shown in FIG. 12 and the timing chart shown in FIG. 13. A power switch (not shown) of the automatic ice making machine is first turned on. Since no ice cake is stored in the ice reservoir 13 at this stage, the ice fullness detector $S_2$ is made open, so that the make and break contact $Ls_1$ of the ice making control unit Ls is closed. Since the traveling contact a of the change-over switch $S_1$ is connected to the fixed contact b, and the traveling contact e of the change-over contact $Ls_2$ is connected to the fixed contact f. Accordingly, as soon as the power switch is turned on, the compressor (CM) 20, fan motor FM, pump motor PM and timer T are energized to start ice making operation. Then, the cooling medium and the water to be frozen are circulated as described referring to FIGS. 1(*a*), (*b*), (*c*) and 2, and thus the temperature of the circulated water and that of the freezing chamber 1 are gradually lowered. When the machine is performing normal ice making operation, the temperature of the water circulated becomes 0° C. after a predetermined time counted from the starting point of the ice making operation, and ice layers start to grow.

When the temperature of the freezing chamber 1 has reached the ice formation completion temperature of below 0° C., the temperature element $Th_2$ detects it and closes the make and break contact $Ls_0$ of the ice making control unit Ls; whereby the make and break contact $Ls_0$ of the ice making control unit Ls is closed and the traveling contact e of the change-over contact $Ls_2$ is changed over to the fixed contact g. Namely, the step 11 in the flow chart shown in FIG. 12 proceeds onto the step 12 to start ice releasing operation. When the ice releasing operation is started, the fan motor FM, pump motor PM and timer T are deenergized and the actuator motor AM is energized. When the water tray 4 and the water tank 5 are fully tilted by the rotation of the actuator motor AM, the traveling contact a of the change-over switch $S_1$ is changed over to the fixed contact c. At this stage, the make and break contact $Ls_3$ of the ice making control unit Ls is assuming an open posture.

The changing over of the change-over switch $S_1$ urges the water feed valve WV to open, whereby another portion of fresh water of normal temperature is supplied to the tank 5 from the external water supply system 10. With the opening of the hot gas valve HV, the evaporator 3 is warmed to accelerate releasing of the ice cakes. When the temperature of the freezing cells 2 has risen after dropping of the ice cakes by their own weight, as described above, the temperature detector $Th_2$ detects it to close the make and break contact $LS_3$. Upon closure of the make and break contact $LS_3$, the actuator motor AM is rotated reversely to return the water tray 4 etc. to the original horizontal posture, and after completion of the resetting motion the traveling contact a of the change-over switch $S_1$ is changed over to the fixed contact b to resume the ice making operation and repeat the above procedures.

Figure 12:
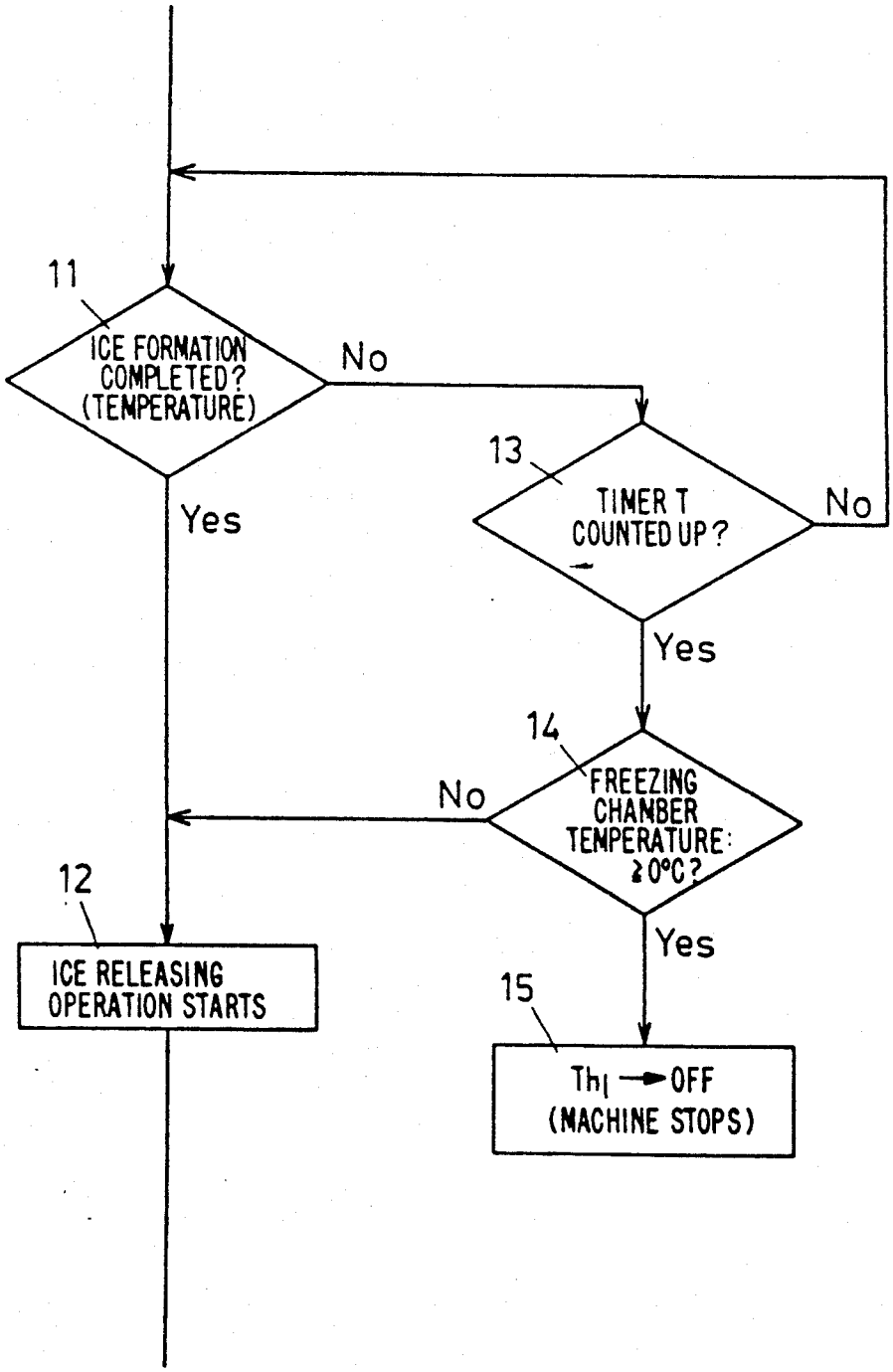
FIG. 12 shows a flow chart explaining the operation of the fourthe embodiment.
Figure 13:
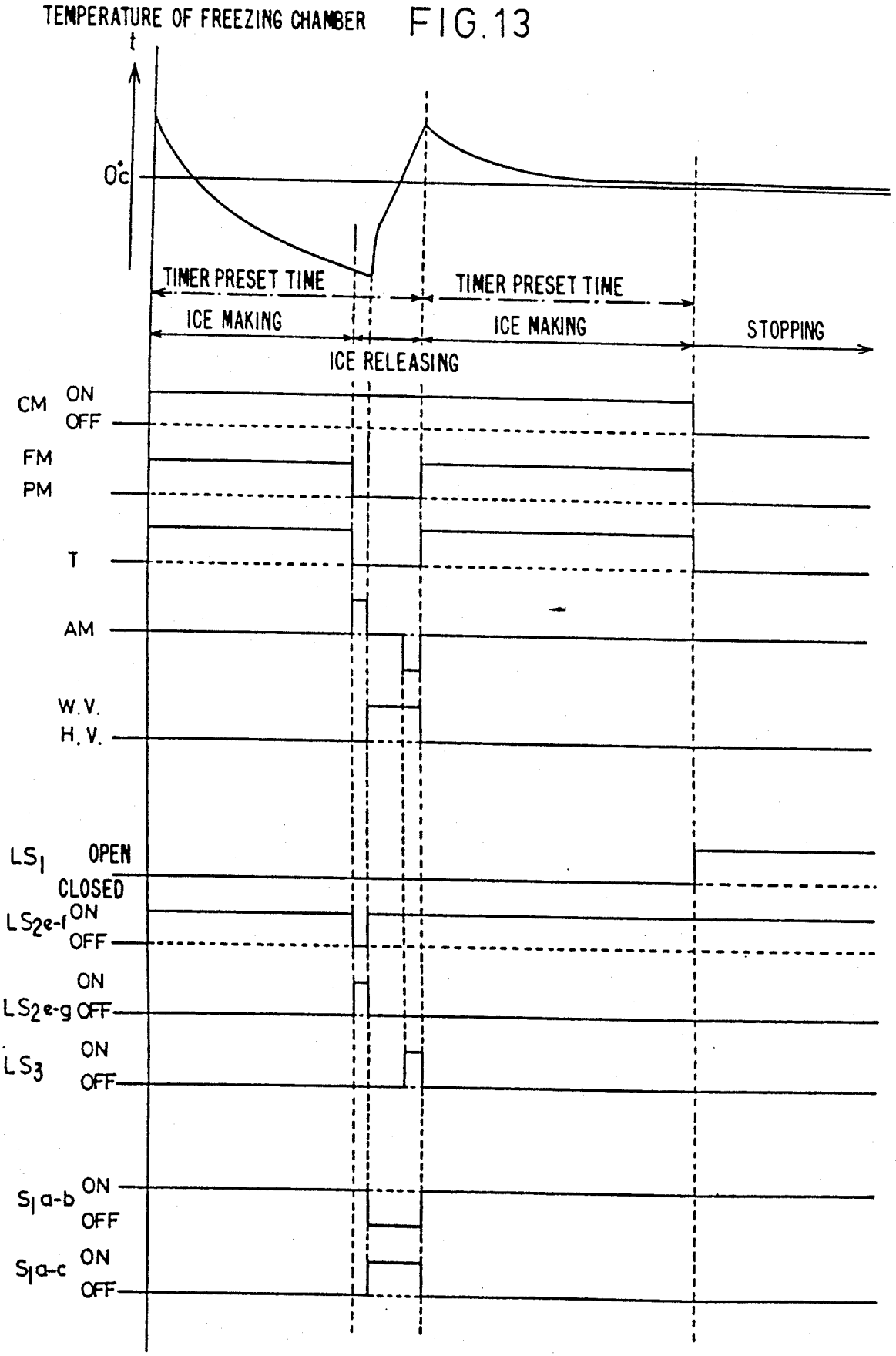
FIG. 13 shows a timing chart explaining the operation of the fourth embodiment.

If the environmental temperature of the automatic ice making machine has risen such as in summer to require longer time for completing the ice making operation, the step 11 of the flow chart shown in FIG. 12 proceeds to the step 13, and the timer T counts up and closes its make and break contact $T_1$ before the temperature element $Th_2$ gives an ice formation completion signal. When the time required for the formation of ice cakes is extended merely for some other reasons as described above even if the ice making machine is performing normal ice making operation, the ice cakes formed in the freezing chamber 1 have a substantially complete form, although not perfect. In other words, the ice making operation is normally performed, so that the freezing chamber may not be elevated above the abnormality preset temperature. Therefore, the step 13 of the flow chart of FIG. 8 proceeds to the step 14 and then to the step 12. Namely, the traveling contact e of the change-over contact Ls is changed over to the fixed contact g to resume the ice releasing operation as described above. Thus, this embodiment provides an advantage that a predetermined amount of ice cakes can be obtained even when the environmental temperature is elevated such as in summer.

If any trouble should have occurred such as the reduction in the condensing power due to the fan locking, condenser clogging, etc., reduction in the water feed pressure or water suspension in a water cooling system condenser, open-phase operation in three-phase compressor, leakage of gaseous cooling medium, compressor trouble, deficient closing operation of the hot gas valve HV and icing in the freezing system to cause chalking, the freezing power of the machine is extremely lowered to be incapable of lowering the temperature of the freezing chamber to 0° C. even if ice making operation is performed. In this state, if the timer T has counted up the preset time to close the contact $T_1$, the step 13 of FIG. 12 proceeds on to the step 14 and then to the step 15, and thus the make and break contact $Ls_1$ is made open, whereby the compressor C.M, fan motor FM and pump motor PM are deenergized.

As described above, the automatic ice making machine according to any of the first to the fourth embodiments can prevent not only breakdown of the compressor which may occur in the prior art ice making machine by inhibiting the compressor to repeat the cycle of overload operation and stopping but also waste of power and water effectively. Incidentally, if an alarm lamp L is disposed parallel to the relay X as shown with a dotted line in FIG. 3, the user can visually find occurrence of some trouble, including fan locking and clogging. Further, occurrence of trouble may be made known audibly by disposing a means which gives an alarm sound such as a buzzer parallel to the alarm lamp and actuating them at the same time.

When the ice making operation is resumed after a required trouble-shooting is made, the reset push button PB is depressed to make its contact to assume an open posture, or the supply of power is shut off to clear the self-retention of the, continuity of the relay X.

While the automatic ice making machine according to this invention has been described referring to that of closed cell system, this invention is not intended to be limited thereto but in various types of ice making machines of open cell system, flow-down system, etc. On the other hand, while a temperature detecting mode (temperature detector $Th_2$) has been described as an example of the means for detecting the completion of ice formation, this invention can be applied to all of the ice making machines employing any of the timer system, water level detection system, pressure detection system, ice thickness detection system, temperature and timer system, water level and timer system, etc. In the above preferred embodiment, while a relay X was used as a constituent of the protection unit, the present invention is not limited thereto. Electronic parts may be used in combination with the respective detectors or timer, and if such combinations still fail to lower the temperature of the water to be frozen within a predetermined time after the ice making operation is started, a protection unit can conveniently be disposed for stopping the ice making operation. Further, it is more preferred to allow an alarm unit to be actuated when some trouble has occurred and the continuity of the contacts $LS_1$ an $Th_1$ are self-retained respectively.

What is claimed is:

1. An automatic ice making machine having an ice making section equipped with an evaporator connected to a freezing system, a water feed system for feeding a water to be frozen to said ice making section, an ice releasing unit for releasing the ice cakes formed in said ice making section and a temperature detector wich detects the temperature of the water to be frozen circulated through he water feed system;

characterized in that said ice making machine further comprises a protection unit which stops the ice making operation after a predetermined time counted from the starting point of the ice making operation, if the temperature of the water to ge frozen does not drop below a predetermined level, and wherein the protection unit has an alarm means which is actuated while the ice making operation is suspended under the protection.

2. An automatic ice making machine having an ice making section equipped with an evaporator connected to a freezing system, a water feed system for feeding a water to be frozen to said ice making section, an ice releasing unit for releasing the ice cakes formed in said ice making section, and a temperature detector which detects the temperature of the water to be frozen circulated through the water feed system;

characterized in that said ice making machine further comprises a protection unit which stops the ice making operation after a predetermined time counted from the starting point of the ice making operation, fi the temperature of the water to be frozen does not drop below a predetermined level, and wherein the protection unit has a means for manually releasing the suspension of ice making operation under the protection.

3. An automatic ice making machine having an ice making section equipped with an evaporator connected to a freezing system, a water feed system for feeding water to be frozen to said ice making section and an ice releasing unit for releasing ice cake formed in said ice making section, said ice making machine be characterized in that it comprises:

a temperature detector in which a preset abnormality temperature is set which is higher than0° C., said temperature detector detecting a temperature of the water to be frozen that circulates in said water feed system and having a normally-closed contact which opens when the temperature of said water to be frozen drops below said preset abnormality temperature and closes when a temperature of said water to be frozen exceeds said preset abnormality temperature;

a timer provided with a normally-opened contact which is serially connected with said normally-closed contact of said temperature detector, an operation time of said timer being set to be longer than a time period which is necessary for the water to be frozen becomes 0° C. after the ice making operation of said ice making section has started and when such a set time is counted up, said normally-opened contact is closed for a predetermined time period and then reopened;

a relay connected between power supply lines through said normally-closed contact of said temperature detector and said normally-opened contact of said timer, said relay having a normally-closed contact provided in said power supply line which is connected to said freezing system; and wherein if, at the item that said timer is counted up and said normally-opened contact is closed, said water temperature is above said preset abnormality temperature and said normally-closed contact of said temperature detector is closed, said relay is energized so that said normally-closed contract of said relay is opened and operation of said freezing system is stopped

4. An automatic ice making machine according to claim 3, wherein said ice making machine has an alarm means which is actuated while the ice making operation is stopped.

5. An automatic ice making machine according to claim 3, wherein said ice making machine has a means for manually releasing the stopping of the ice making operation.

* * * * *